US005669434A

United States Patent [19]

Nakao et al.

[11] Patent Number: 5,669,434

[45] Date of Patent: Sep. 23, 1997

[54] METHOD AND APPARATUS FOR FORMING AN ALUMINUM ALLOY COMPOSITE MATERIAL

[75] Inventors: Yasuhiro Nakao; Kunitoshi Sugaya, both of Sayama, Japan

[73] Assignee: Honda Giken Kogyo Kabushiki Kaisha, Japan

[21] Appl. No.: 548,020

[22] Filed: Oct. 25, 1995

[30] Foreign Application Priority Data

Oct. 26, 1994 [JP] Japan ..... 6-262803
Dec. 6, 1994 [JP] Japan ..... 6-302349

[51] Int. Cl.[6] ..... B22D 19/14

[52] U.S. Cl. ..... 164/97; 164/98

[58] Field of Search ..... 164/97, 98

[56] References Cited

U.S. PATENT DOCUMENTS 5,007,475 4/1991 Kennedy et al. ..... 164/97
5,119,864 6/1992 Langensiepen et al. ..... 164/97
5,505,248 4/1996 Aghajanian et al. ..... 164/97

FOREIGN PATENT DOCUMENTS 369931 5/1990 European Pat. Off. .
9117011 11/1991 WIPO .

*Primary Examiner*—Kuang Y. Lin
*Attorney, Agent, or Firm*—Adams & Wilks

[57] ABSTRACT

A method for producing an aluminum alloy composite material comprises disposing in a mold, in sequence from bottom to top, an infiltration enhancer containing Mg, a preform and an aluminum matrix alloy ingot, and then inserting the mold into an atmospheric furnace. The interior of the atmospheric furnace is then turned into an argon atmosphere. Thereafter, the internal temperature of the furnace is raised to a first predetermined temperature which is maintained for a given period of time so that the infiltration enhancer sublimates to permit the Mg component thereof to infiltrate into the preform. The atmosphere inside the furnace is then turned from the argon atmosphere into a nitrogen atmosphere. Thereafter, the internal temperature of the furnace is raised to a second predetermined temperature higher than the first predetermined temperature and maintained for a given period of time so that the aluminum matrix alloy ingot melts to permit the aluminum matrix alloy to spontaneously infiltrate into the preform. The interior of the furnace is then cooled to thereby produce an aluminum alloy composite material of high-quality.

13 Claims, 5 Drawing Sheets

METHOD AND APPARATUS FOR FORMING AN ALUMINUM ALLOY COMPOSITE MATERIAL

FIELD OF THE INVENTION

The present invention relates to a method and apparatus for forming an aluminum alloy composite material by spontaneously infiltrating a molten aluminum alloy into a preform (fiber compact) under an atmospheric pressure.

BACKGROUND OF THE INVENTION

When spontaneously infiltrating a molten aluminum alloy into a preform of short alumina fibers under an atmospheric pressure, improved wettability is required of the alumina fibers and molten aluminum alloy. In a known method for forming an aluminum alloy composite material, such wettability is improved by producing magnesium nitride ($Mg_3N_2$) on the surfaces of alumina fibers employing a magnesium (Mg) gas and a nitrogen ($N_2$) gas for activating reduction of the fiber surfaces, whereafter molten aluminum alloy is positively introduced into the preform through gaps between the fibers by capillarity. In this instance, a technique is also known in which a matrix metal composed of a magnesium-contained aluminum alloy is employed as an Mg gas supply source. The technique in which an aluminum alloy is employed as a matrix metal is disclosed, for example, in U.S. Pat. No. 5,119,864 and International Publication No. WO 91/17011.

The method of forming an aluminum alloy composite material, disclosed in U.S. Pat. No. 5,119,864 and International Publication No. WO 91/17011, comprises the steps of disposing an aluminum matrix alloy ingot containing magnesium (Mg) upon a preform (fiber compact) and spontaneously infiltrating molten aluminum matrix alloy into the preform under an atmospheric pressure.

In the prior art, when heated to a predetermined temperature, the aluminum matrix alloy ingot melts, and at the same time the Mg component contained in the ingot is sublimated, part of which Mg component infiltrates into the preform and activates reduction of the surfaces of the fibers in the preform to enhance wettability thereof, thereby enhancing formation of the composite of aluminum matrix alloy.

However, since the aluminum matrix alloy ingot is positioned above the preform, most of the sublimated Mg component can hardly infiltrate into the preform positioned below. As a result, sufficient wettability may not be provided to the surfaces of the fibers in the preform.

Consequently, a high-quality composite may not be obtained in that the molten aluminum matrix alloy does not sufficiently infiltrate into the preform. Further, a lengthy time is required to produce a satisfactory composite.

The mentioned U.S. Pat. No. 5,119,864 and International Publication WO 91/17011 also disclose apparatus for producing an aluminum alloy composite material. FIG. 8 shows one example of such apparatus. Referring to FIG. 8, a brief explanation will be made On such prior art apparatus. The apparatus is formed by positioning a graphite ring 52 upon a preform 51 containing magnesium, spraying an aerosol of colloid graphite 53 around the preform 51 and drying it, disposing the preform 51 and graphite ring 52 within granular alumina 55 filled in a graphite vessel 54, and then placing a matrix metal ingot 57 of pure aluminum metal upon the graphite ring 52.

This apparatus enhances wettability of the preform 51 per se by the reducing action of the magnesium contained in the preform and causes molten matrix metal 57 to infiltrate into the preform 51 to thereby produce a metal matrix composite. The apparatus achieves spontaneous infiltration and can be appreciated in this sense.

However, because it is positioned over the preform 51 through the graphite ring 52, the matrix metal ingot 57 is separated from the preform 51 by the space of the graphite ring 52. Thus, when the temperature is raised to reach a predetermined temperature, the matrix metal ingot 57 melts first in relation to the mp (melting points) and comes into contact with the preform 51 but, at this point in time the Mg contained in the preform 51 is not at its sublimation temperature, or is not sufficiently sublimated. For this reason, the interior of the preform 51 does not as yet have sufficient wettability. Consequently, molten matrix alloy does not sufficiently infiltrate into the preform, and hence a higher-quality aluminum alloy composite material may not be obtained.

It is therefore an object of the present invention to provide a method for producing an aluminum alloy composite material wherein a higher-quality aluminum alloy composite material can be obtained easily and conveniently.

Another object of the present invention is to provide an apparatus for producing an aluminum alloy composite material, which is simple in construction and enables efficient production of a higher-quality aluminum alloy composite material.

SUMMARY OF THE INVENTION

To meet the first object, in a first aspect of the present invention, there is provided a method for producing an aluminum alloy composite material in an atmospheric furnace accommodating a mold therein and having an atmospheric gas injector, a pressure reducing unit and a heating unit by spontaneously infiltrating a molten aluminum alloy into a preform under an atmospheric pressure, comprising the steps of: disposing an infiltration enhancer containing Mg, a preform and an aluminum matrix alloy ingot in sequence from below to above in the mold; turning the interior of the atmospheric furnace into a nitrogen atmosphere by the atmospheric gas injector and pressure reducing unit; raising the internal temperature of the furnace up to a predetermined temperature by the heating unit; sublimating the infiltration enhancer and reducing the surfaces of fibers in the preform by the reaction of a magnesium gas and a nitrogen gas; melting the ingot and infiltrating the molten aluminum matrix alloy into the preform; and cooling the interior of the atmospheric furnace.

The atmospheric gas injector may be adapted to inject an argon (Ar) gas and a nitrogen ($N_2$) gas such that the Ar gas is injected first and then the nitrogen gas after lapsing of a predetermined time.

Another aluminum matrix alloy ingot may also be disposed below the infiltration enhancer containing Mg.

In this method, since the Mg component of the infiltration enhancer infiltrates into the preform from below and reduces the surfaces of the fibers in the preform, the wettability of the preform becomes sufficiently high and the molten aluminum matrix alloy can infiltrate sufficiently into the preform, thereby enabling a smooth composite material formation.

By changing the atmosphere in the furnace from the Ar gas to the $N_2$ gas during heating, the Mg component of the infiltration enhancer infiltrates throughout every inside corner of the preform, thereby enabling formation of a more complete composite material.

When aluminum matrix alloy ingots are disposed above and below the preform, the molten aluminum matrix alloy infiltrates into the preform from above and below, thus shortening the required infiltration time.

As described above, since the molten aluminum matrix alloy is arranged to infiltrate into the preform after the Mg component of the infiltration enhancer infiltrates into the preform from below and reduces the surfaces of the fibers in the preform and consequently the wettability of the preform has become sufficiently high, a higher quality aluminum alloy composite material can be produced efficiently by a simple and easy operation.

To meet the second object, there is provided, in a second aspect of the present invention, an apparatus for producing an aluminum alloy composite material by employing an infiltration enhancer containing Mg and spontaneously infiltrating a molten aluminum alloy into a preform consisting of metal oxide to form a composite body, which comprises: a first mold for housing an aluminum alloy ingot; a second mold placed above said aluminum alloy ingot inside said first mold and having a communicating hole in the bottom: a sealing material to seal said communicating hole in the bottom of said second mold and to melt at a predetermined temperature; an infiltration enhancer to be housed in said second mold; and a preform disposed over said infiltration enhancer and closely mated with the inner wall of said second mold.

The infiltration enhancer is pure magnesium.

After putting the producing apparatus, for example, into a vacuum furnace and reducing the pressure, on raising the temperature inside the furnace less than the melting point of a sealing material and above that of an infiltration enhancer (above the melting point of aluminum alloy ingot), the infiltration enhancer is sublimated first and infiltrates into the preform. Then, if the infiltration enhancer is magnesium, the surfaces of the fibers in the preform are subjected to activated reduction by introducing an $N_2$ gas into the vacuum furnace and forming $Mg_3N_2$ on the surface. At the same time, the aluminum alloy ingot is also melted but may not enter the second mold due to the presence of the sealing material and the wettability of the surfaces of the fibers in the preform body is sufficiently improved during this period of time.

When the temperature inside the furnace is further raised to above the melting point of the sealing material, the sealing material melts, the communicating hole in the bottom of the second mold becomes a through state and the molten aluminum alloy penetrates into the second mold. The molten aluminum alloy then makes contact with the preform and infiltrates into the fibers with improved wettability by capillarity, so that composite material formation can be fulfilled. Use of pure aluminum as the sealing material is advantageous in that it is possible to make the melting point higher than that of the aluminum alloy ingot, and in that the resultant solution is same in nature and quality as that of the aluminum alloy ingot.

As is now apparent, in the inventive apparatus, wettability is improved by sealing the communicating hole provided at the bottom of the second mold and sufficiently infiltrating the infiltration enhancer into the preform by melting of the sealing material. Since it is arranged such that the aluminum alloy ingot is melted first and then the sealing material is fused to cause the molten aluminum alloy to be brought into contact with the preform through the communicating hole, spontaneous infiltration proceeds smoothly, whereby formation of a high-quality aluminum alloy composite material is enabled.

The present invention provides additional advantages in that the apparatus is simple in construction and hence inexpensive and in that it may be operated easily and requires less working time.

BRIEF DESCRIPTION OF THE DRAWINGS

Preferred embodiments of the present invention will now be discussed in detail, by way of example only, with reference to the accompanying drawings, in which.

DETAILED DESCRIPTION OF THE PREFERRED EMBODIMENTS

Figure 1:
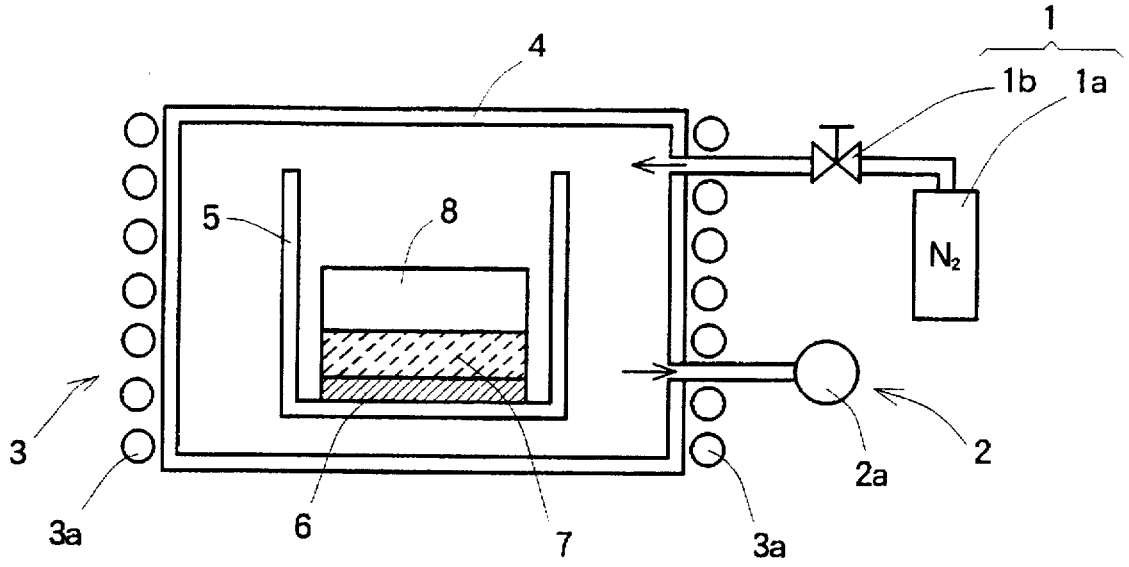
FIG. 1 is a view illustrating a method of producing an aluminum alloy composite material according to a first embodiment of the present invention.

FIG. 1 shows a method for producing an aluminum alloy composite material according to a first embodiment of the present invention. The method for producing an aluminum alloy composite material, as shown in FIG. 1, is carried out by use of an atmospheric furnace 4 having an atmospheric gas injector 1, a pressure reducer 2 and a heating unit 3. The atmospheric gas injector 1, equipped with an $N_2$ (nitrogen gas) cylinder 1*a* and a valve 1*b*, is designed to inject $N_2$ (nitrogen gas) into the interior of the atmospheric furnace 4. The pressure reducer 2, equipped with a vacuum pump 2*a* and the like, is designed to evacuate the interior of the atmospheric furnace 4. The heating unit 3, equipped with heaters 3*a* disposed around the atmospheric furnace 4, is designed for controlling the temperature of the inside of the atmospheric furnace 4 via a controller C by use of a furnace temperature sensor (S) and the like and raising it up to a desired temperature.

First, as an infiltration enhancer (composite formation initiator) 6, put 15 g of pure Mg (99% pure) into a mold 5 serving as a crucible, then place a preform ($Al_2O_3$ short fiber compact, 100 mm in diameter, 50 mm in thickness and vf=20% in volume content) 7 thereabove, and thereafter place 1500 g of pure aluminum (99.99% pure) as an aluminum (Al) matrix alloy ingot 8 thereabove. At this time, the infiltration enhancer 6 is chosen to be a circular board having an outer diameter of 100 mm which is equal to a diameter of the preform 7.

The term "infiltration enhancer" used herein represents a material which promotes or assists in the spontaneous infiltration of a matrix metal into a preform, for which Mg is used in this embodiment as mentioned above.

Figure 2:
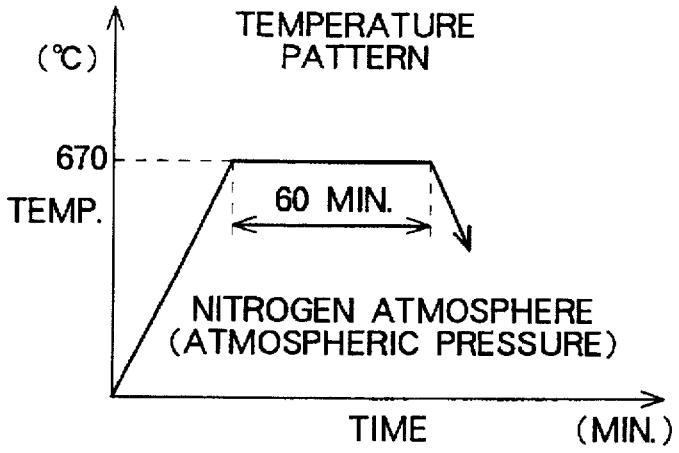
FIG. 2 is a graph showing a temperature pattern of heating by use of a nitrogen atmosphere.

Next, install the mold 5 containing the infiltration enhancer 6, preform 7 and aluminum alloy ingot 8 in the atmospheric furnace 4 and turn the atmosphere inside the atmospheric furnace 4 into a nitrogen atmosphere (atmospheric pressure) through the vacuum displacement by the atmospheric gas injector 1 and pressure reducing mean 2. Thereafter, as shown in FIG. 2, the internal temperature of the atmospheric furnace 4 is raised at the rate of b 10° C./min. by the heating unit 3. With such increase in the internal temperature of the atmospheric furnace 4 under the nitrogen atmosphere, the infiltration enhancer 6 positioned below the preform 7 is first sublimated at 500° C., and the Mg component infiltrates into the preform 7 from below.

With a further increase in temperature, magnesium nitride ($Mg_3N_2$) is produced on the surfaces of the fibers in the preform 7, and the surfaces in the preform 7 are reduced and metallized. On raising the internal temperature of the atmospheric furnace 4 up to 670° C. and maintaining this temperature for 60 min. as shown in FIG. 2, molten aluminum matrix alloy infiltrates from above the preform 7 into the preform 7 during this period of time.

As mentioned above, since the surfaces of the fibers in the preform 7 are metallized and have increased wettability, composite formation proceeds rapidly. Thereafter, as the interior of the atmospheric furnace 4 is cooled down and the mold 5 is taken out from the atmospheric furnace 4, there is formed in the mold 5 a composite material by infiltration of aluminum into the $Al_2O_3$ short fiber compact.

Figure 3:
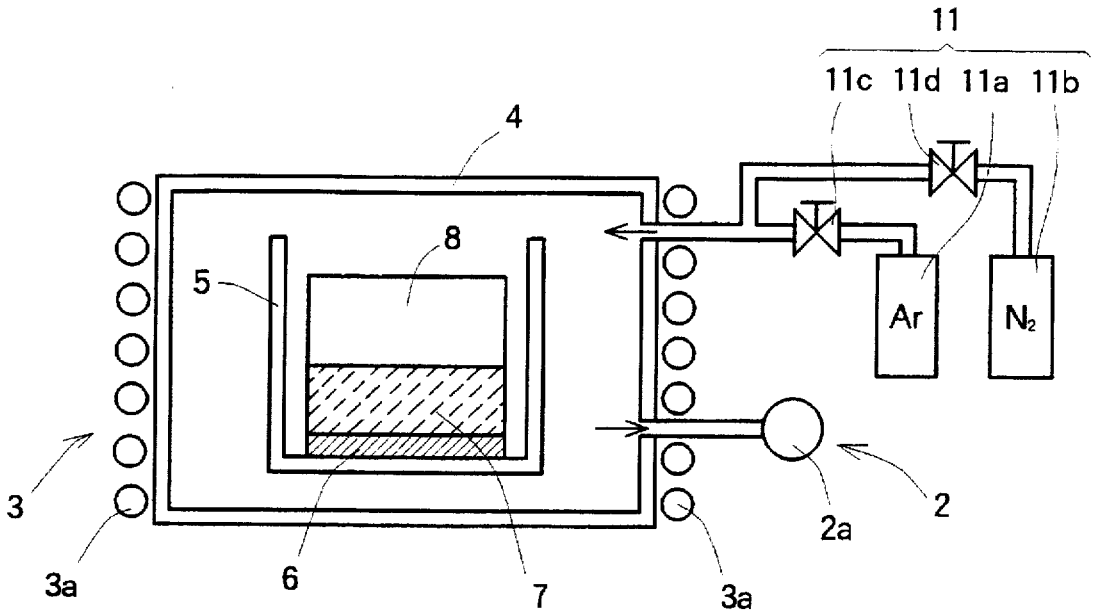
FIG. 3 is a view illustrating a method of producing an aluminum alloy composite material according to a second embodiment of the present invention.

FIG. 3 shows a method for producing an aluminum alloy composite material according to a second embodiment of the present invention. The method shown in FIG. 3 is carried out by injecting an Ar (argon) gas or an $N_2$ (nitrogen) gas into the atmospheric furnace 4 with an atmospheric gas injector 11 provided comprising an Ar gas cylinder 11*a*, an $N_2$ gas cylinder 11*b*, a valve 11*c* for Ar and a valve 11*d* for $N_2$.

In FIG. 3, put 15 g of pure Mg (99% pure) into the mold 5 as an infiltration enhancer (composite formation initiator) 6, then place a preform 7 ($Al_2O_3$ short fiber compact, 100 mm in diameter, 70 mm in thickness and vf=20% in volume content) thereabove, and further place 1500 g of pure aluminum (99.99% pure) as an aluminum matrix alloy ingot 8 thereabove. At that time, the infiltration enhancer 6 is chosen to be in the form of a circular board having an outer diameter of 100 mm which is equal to the diameter of the preform 7. The thickness of the preform 7 is larger than that in the first embodiment.

Figure 4:
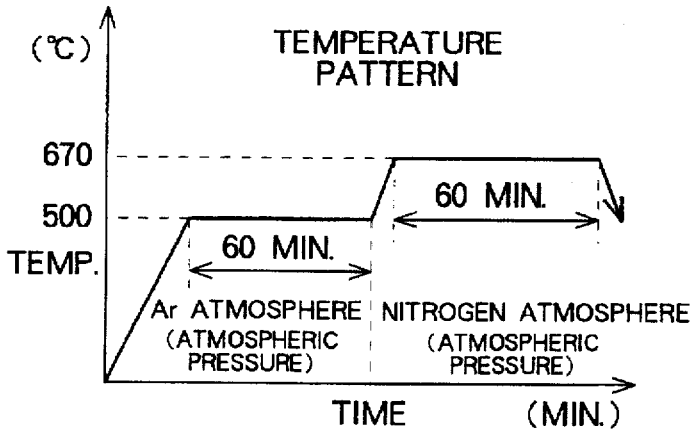
FIG. 4 is a graph showing a temperature pattern of heating by use of an argon atmosphere and a nitrogen atmosphere.

Next, install the mold 5, containing the infiltration enhancer 6, preform 7 and aluminum alloy ingot 8, in the atmospheric furnace 4 and turn the atmosphere inside the atmospheric furnace 4 into an argon atmosphere (atmospheric pressure) through the vacuum displacement by the atmospheric gas injector 11 and pressure reducing unit 2. Thereafter, as shown in FIG. 4, raise the internal temperature of the atmospheric furnace 4 at the rate of 10° C./min. up to 500° C. by the heating unit 3 and maintain this temperature for 60 min. Thereupon, the infiltration enhancer 6 positioned below the preform 7 is first sublimated, and the Mg component infiltrates into the preform 7 from below.

Then again, turn the atmosphere inside the atmospheric furnace 4 from an argon atmosphere (atmospheric pressure) into a nitrogen atmosphere (atmospheric pressure) through the vacuum displacement by the atmospheric gas injector 11 and pressure reducing mean 2 before raising the internal temperature of the atmospheric furnace 4 at the rate of 10° C./min. by the heating unit 3, as shown in FIG. 4.

The reason for heating the interior of the atmospheric furnace 4 first under an inert, argon gas atmosphere (atmospheric pressure) and then continuing with the heating under a nitrogen atmosphere (atmospheric pressure) is to at first suppress the Mg component of the infiltration enhancer 6 from reacting with $N_2$ (nitrogen gas) to generate magnesium nitride ($Mg_3N_2$) and to secure the time for the Mg component to sufficiently infiltrate into the preform 7, because the Mg component, though not reacting with $N_2$ (nitrogen gas) at lower temperatures, reacts with $N_2$ (nitrogen gas) and becomes likely to generate magnesium nitride ($Mg_3N_2$) at higher temperatures.

If the infiltration time is secured by setting the atmosphere inside the atmospheric furnace 4 to an argon atmosphere (atmospheric pressure), the Mg component reacts with $N_2$ (nitrogen gas) after sufficiently infiltrating into the preform 7, so that magnesium nitride ($Mg_3N_2$) is formed on the surfaces of the fibers in the preform 7 and the wettability increases.

Furthermore, on raising the internal temperature of the atmospheric furnace 4 up to 670° C. as shown in FIG. 4, magnesium nitride ($Mg_3N_2$) is formed on the surface of the preform 7, and the surface of the preform 7 is reduced and metallized as described above. On maintaining the temperature of 670° C. for 60 min., the molten aluminum matrix alloy infiltrates from above the preform 7 into the preform 7 during this period of time.

Again, as mentioned above, since the surfaces of the fibers in the preform 7 are metallized and have increased wettability, composite formation proceeds rapidly. Thereafter, as the interior of the atmospheric furnace 4 is cooled down and the mold 5 is taken out from the atmospheric furnace 4, there is formed in the mold 5 a composite material in which aluminum is infiltrated into the $Al_2O_3$ short fiber compact.

A change in the internal temperature of the atmospheric furnace 4 from an argon atmosphere (atmospheric pressure) to an oxygen atmosphere (atmospheric pressure) is effective in a somewhat thicker preform 7, especially when it is desired to secure the time for the Mg component of an infiltration enhancer 6 to sufficiently infiltrate into the preform 7.

Figure 5:
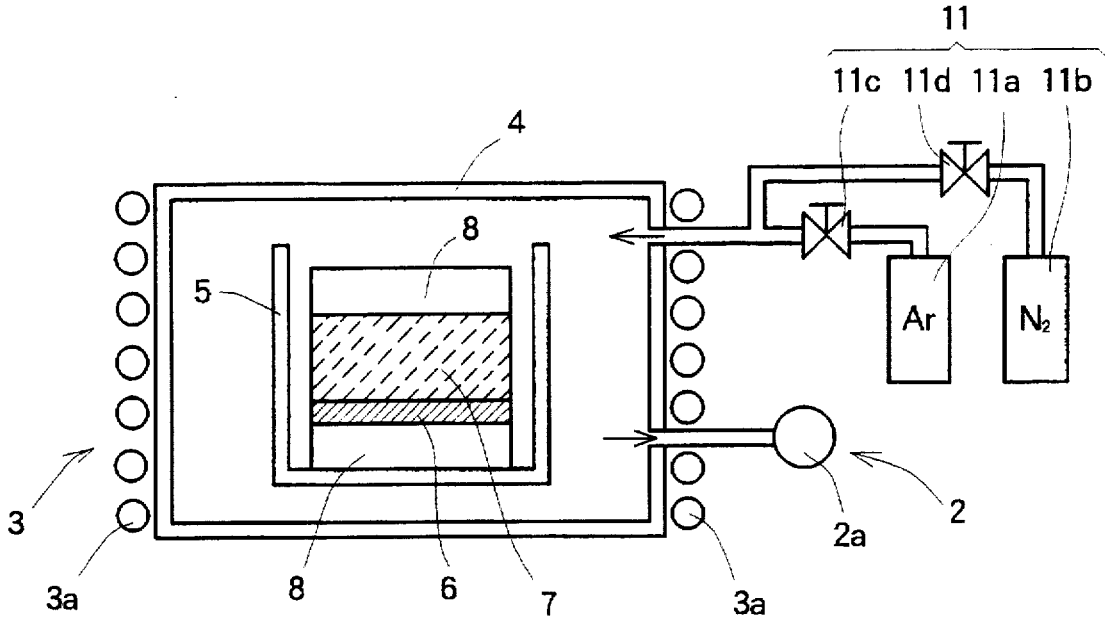
FIG. 5 illustrates a method of producing an aluminum alloy composite material according to a third embodiment of the present invention.

FIG. 5 shows a method for producing an aluminum alloy composite material according to a third embodiment of the present invention. In the method shown in FIG. 5, the composite formation is carried out employing a separate aluminum matrix alloy ingot 8 disposed under the infiltration enhancer 6 containing Mg.

First, put 750 g of JIS-AC4C material (aluminum alloy casting) into the mold 5 as the ingot 8, then place 15 g of 15% Mg-Al alloy thereabove as an infiltration enhancer 6 (composite formation initiator), further place a preform 7 ($Al_2O_3$ short fiber compact, 100 mm in diameter, 70 mm in thickness and vf=20% in volume content) thereabove and again place 750 g of the AC4C material as the aluminum matrix alloy ingot 8 thereabove. At this time, infiltration enhancer 6 comprises particles having a size of the order of 1 to 5 mm and is so placed at all corners as to touch the whole bottom of the preform 7.

Next, install the mold 5, containing the ingot 8, infiltration enhancer 6, preform 7 and ingot 8, in the atmospheric furnace 4 and turn the atmosphere inside the atmospheric furnace 4 into an argon atmosphere (atmospheric pressure) through the vacuum displacement by the atmospheric gas injector 11 and pressure reducing unit 2. Thereafter, as shown in FIG. 4, raise the internal temperature of the atmospheric furnace 4 at the rate of 10° C./min. up to 500° C. by the heating unit 3 and maintain this temperature for 60 min. Thereupon, the infiltration enhancer 6 positioned below the preform 7 is first sublimated, and the Mg component infiltrates into the preform 7 from below.

Then again, turn the atmosphere inside the atmospheric furnace 4 from the argon atmosphere (atmospheric pressure) into a nitrogen atmosphere (atmospheric pressure) through the vacuum displacement by the atmospheric gas injector 11 and pressure reducing unit 2 before raising the internal temperature of the atmospheric furnace 4 at the rate of 10° C./min. by the heating unit 3, as shown in FIG. 4.

Furthermore, on raising the internal temperature of the atmospheric furnace 4 up to 670° C., magnesium nitride ($Mg_3N_2$) is formed on the surface of the preform 7, and the surface of the preform 7 is reduced and metallized. On maintaining the temperature of 670° C. for 60 min. as shown in FIG. 4, molten aluminum matrix alloy infiltrates from above the preform 7 into the preform 7 during this period of time. As mentioned above, since the surfaces of the fibers in the preform 7 are metallized and increase in wettability, composite material formation proceeds rapidly. Thereafter, as the interior of the atmospheric furnace 4 is cooled down and the mold 5 is taken out from the atmospheric furnace 4, there is provide in the mold 5 a composite material in which aluminum is infiltrated into the $Al_2O_3$ short fiber compact.

In this manner, by disposing the divided portions of the aluminum matrix ingot 8 above and below the preform 7, molten aluminum matrix alloy infiltrates into the preform 7 from above and from below, thereby shortening the infiltration time.

Also, when the divided portions of the aluminum matrix alloy ingot 8 are disposed above and below the preform 7, the composite formation can processed by heating the internal atmosphere of the furnace 4 under a nitrogen atmosphere (atmospheric pressure) alone if the preform 7 is as thick as that of the first embodiment shown in FIG. 1.

Figure 6:
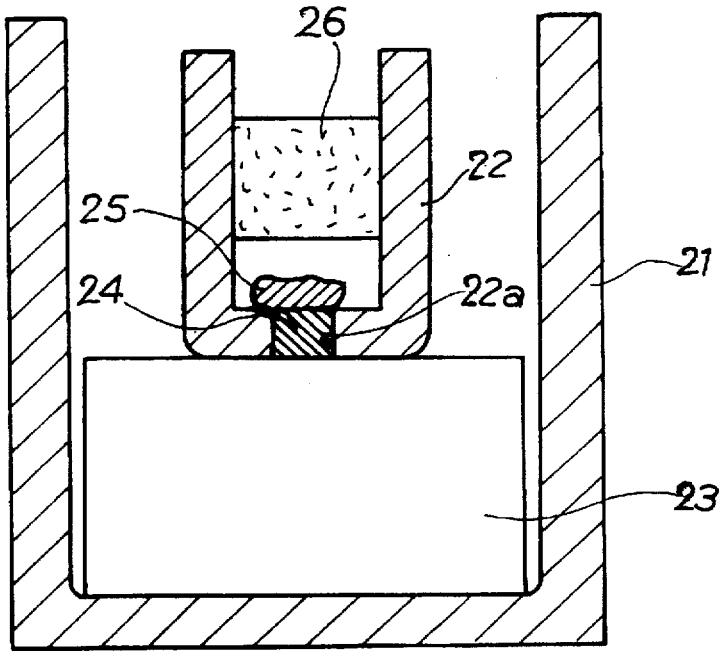
FIG. 6 is a schematic view illustrating the structure of an apparatus for producing the aluminum alloy composite material according to the present invention.

FIG. 6 schematically shows the apparatus according to the present invention. An explanation will be given on the apparatus hereinbelow.

The apparatus is designed to form a composite material by use of an aluminum alloy as a matrix metal constituting the metal base and through a spontaneous infiltration under an atmospheric pressure and comprises, for example, a first mold 21 as crucible made of ceramics and a second mold 22 made of graphite or ceramics.

Inside the first mold 21, an aluminum alloy ingot 23 is housed as a matrix metal, and a second mold 22 is placed above the aluminum alloy ingot 23.

The second mold 22 has a communicating hole **22*a* in the bottom, with which hole 22*a* a sealing material 24, such as pure aluminum having a higher melting point than that of the aluminum alloy ingot 23, is mated and seals the communicating hole 22*a***.

Inside this second mold 22, a predetermined amount of infiltration enhancer 25, such as magnesium, is housed. Above the infiltration enhancer 25, a preform 26 is disposed as a precursory compact. This preform 26 butts against the inner wall of the second form 22 without a space in such a manner as to fall in a close contact by abutment or mating.

After the apparatus according to the present invention as above is placed within the vacuum furnace and the pressure is lowered to 10 mm/Hg, the interior of the furnace is heated at the rate of 10° C./min. above 500° C. and less than the melting point of the sealing material 24, such as pure aluminum. By this heating, the infiltration enhancer 25, such as magnesium, is sublimated first and effectively infiltrates into the preform 26 because there is no place for it to escape. If the infiltration enhancer 25 is magnesium and Mg gas is sublimated, the wettability may be promoted by introducing an $N_2$ (nitrogen) gas into the vacuum furnace up to 1 atm, forming $Mg_3N_2$ and coating the surfaces of the fibers in the preform 26 with $Mg_3N_2$. At this time, the aluminum alloy ingot 23 in the first mold 21 is also melted but may not be brought into contact with the preform 26 due to the blockade of the communicating hole **22*a* with the sealing material 24, and hence sufficient wettability may be achieved by the preform 26** during this period of time.

Thereafter, when the internal temperature of the furnace is further raised above the melting point of the sealing material 24, the sealing material 24 fuses, the communicating hole **22*a* becomes a through state. Because the fibers in the preform 26 have sufficient wettability as mentioned above, the molten aluminum alloy infiltrates into the preform 26 by capillarity, thus causing the composite of the preform 26** and aluminum alloy to be smoothly formed.

Next, a concrete implementation according to this producing apparatus will be described.

First, provide an alumina tray, 100 mm in inside diameter and 200 mm in height, as a first mold 21 and house an aluminum alloy ingot 23 of JIS-AC4C (98 mm ϕ and 60 mm high) in this tray.

Next, place a second mold 22 comprising a graphite crucible, 60 mm in inside diameter and 100 mm in height, above the aluminum alloy ingot 23. Plug up the communicating hole **22*a*, 15 mm in diameter, formed in the bottom of the second mold 22 with a sealing material 24 made of pure aluminum. Put 7 g of pure magnesium as an infiltration enhancer 25 and fit a preform 26 made of alumina short fibers, 60 mm in diameter and 60 mm in height, into its top in such a manner as to fall in close contact. The fiber content (Vf) of this preform 26** is 30%.

Figure 7:
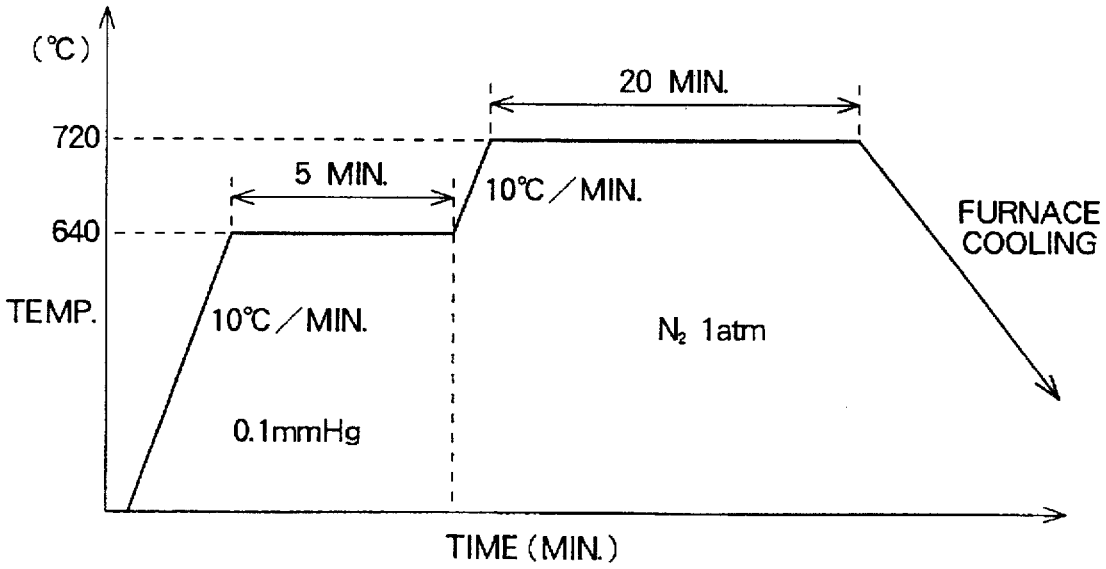
FIG. 7 illustrates a mode of processing of the apparatus of FIG. 6.
Figure 8:
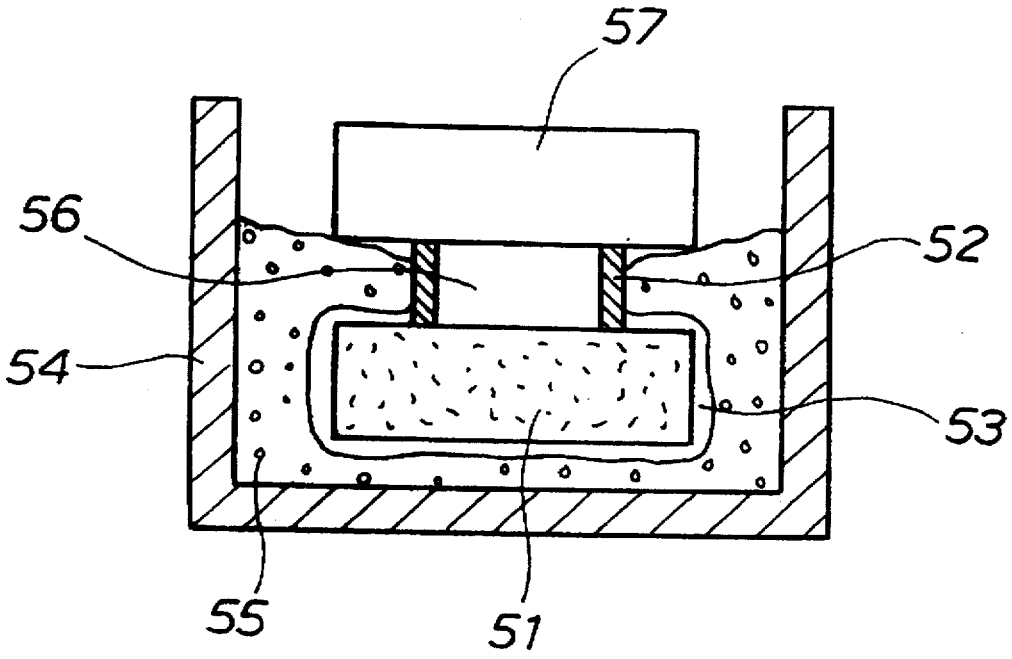
FIG. 8 PRIOR ART
FIG. 8 is a schematic view illustrating a conventional composite material forming apparatus.

After the thus assembled apparatus is put into the vacuum furnace and the pressure is lowered down to 0.1 mmHg in accordance with the procedure shown by the graph of FIG. 7, raise the internal temperature of the atmospheric furnace 4 at the rate of 10° C./min. up to 640° C. and maintain this temperature for 5 min. Then, introduce $N_2$ gas into the vacuum furnace by 1 atm and heat the furnace at the rate of 10° C./min. up to 720° C. After the temperature is maintained for 20 min, the interior of the vacuum furnace was cooled and the assembled apparatus was taken out. The preform 26 is provided in a complete composite form.

In the present invention, needless to say, a high magnesium content of an aluminum alloy ingot 23 is tolerable.

The sealing material 24 fulfills a function of so-called time delay needed till the preform 26 is reduced to have increased wettability. It is also possible to mechanically construct the sealing material 24 for fulfilling such a function, but a mold for producing such a composite material is ordinarily used only for a single article. Thus, when used once, the mold is usually destroyed and therefore an inexpensive construction as seen in the present invention is especially useful.

What is claimed is:

1. A method for producing an aluminum alloy composite material in an atmospheric furnace accommodating a mold therein and having an atmospheric gas injector, a pressure reducing unit and a heating unit by spontaneously infiltrating a molten aluminum alloy into a preform under an atmospheric pressure, comprising the steps of:

disposing in the mold in sequence from bottom to top an infiltration enhancer containing Mg, a preform and an aluminum matrix alloy ingot;

turning the interior of the atmospheric furnace into an argon atmosphere by means of the atmospheric gas injector and the pressure reducing unit;

raising the internal temperature of the furnace up to a first predetermined temperature by means of the heating unit and maintaining the first predetermined temperature for a given period of time so that the infiltration enhancer sublimates to permit the Mg component thereof to infiltrate into the preform;

turning the interior of the furnace from the argon atmosphere into a nitrogen atmosphere by means of the atmospheric gas injector and the pressure reducing unit;

raising the internal temperature of the furnace up to a second predetermined temperature higher than the first predetermined temperature by means of the heating unit and maintaining the second predetermined temperature for a given period of time so that the ingot melts to permit the molten aluminum matrix alloy to infiltrate into the preform; and cooling the interior of the atmospheric furnace.

2. A method for producing an aluminum alloy composition material as set forth in claim 1; wherein the disposing step includes disposing another aluminum matrix alloy ingot below the infiltration enhancer containing the Mg.

3. A method of producing an aluminum alloy composite material, comprising the steps of:

disposing in a mold an infiltration enhancer containing Mg, a preform and an aluminum matrix alloy ingot;

placing the mold containing the infiltration enhancer, the preform and the aluminum matrix alloy ingot into an atmospheric furnace;

providing an argon atmosphere inside of the furnace;

raising the internal temperature of the furnace to a first temperature and maintaining the first temperature for a given period of time so that the infiltration enhancer sublimates to permit the Mg component thereof to infiltrate into the preform;

changing the atmosphere inside of the furnace from the argon atmosphere into a nitrogen atmosphere;

raising the internal temperature of the furnace to a second temperature higher than the first temperature and maintaining the second temperature for a given period of time so that the aluminum matrix alloy ingot melts to permit the aluminum matrix alloy to spontaneously infiltrate into the preform; and cooling the interior of the furnace.

4. A method for producing an aluminum alloy composite material as set forth in claim 3; wherein the disposing step includes sequentially disposing the infiltration enhancer, the preform and the aluminum matrix alloy ingot into the mold.

5. A method for producing an aluminum alloy composite material as set froth in claim 4; including the step of disposing another aluminum matrix alloy ingot into the mold prior to disposing the infiltration enhancer therein.

6. A method for producing an aluminum alloy composite material as set forth in claim 3; wherein the disposing step includes disposing another aluminum matrix alloy ingot into the mold.

7. A method of producing an aluminum alloy composite material, comprising the steps of:

disposing in a mold an infiltration enhancer containing Mg, a preform and an aluminum matrix alloy ingot;

heating in the interior of a furnace the mold containing the infiltration enhancer, the preform and the aluminum matrix alloy ingot in an argon atmosphere to a first temperature and maintaining the first temperature for a given period of time so that the infiltration enhancer sublimates to permit the Mg component thereof to infiltrate into the preform;

thereafter heating the mold in a nitrogen atmosphere to a second temperature higher than the first temperature and maintaining the second temperature for a given period of time so that the aluminum matrix alloy ingot melts to permit the aluminum matrix alloy to spontaneously infiltrate into the preform; and cooling the interior of the furnace.

8. A method for producing an aluminum alloy composite material as set forth in claim 7; wherein the disposing step includes sequentially disposing the infiltration enhancer, the preform and the aluminum matrix alloy ingot into the mold.

9. A method for producing an aluminum alloy composite material as set forth in claim 8; including the step of disposing another aluminum matrix alloy ingot into the mold prior to disposing the infiltration enhancer therein.

10. A method for producing an aluminum alloy composite material as set forth in claim 7; wherein the disposing step includes disposing another aluminum matrix alloy ingot into the mold.

11. A method for producing an aluminum alloy composite material, comprising the steps of:

sequentially disposing in a mold a first aluminum matrix alloy ingot, an infiltration enhancer containing Mg, a preform and a second aluminum matrix alloy ingot;

placing the mold containing the first aluminum matrix alloy ingot, the infiltration enhancer, the preform and the second aluminum matrix alloy ingot in a furnace;

providing an argon atmosphere inside of the furnace;

sublimating the infiltration enhancer while in the furnace provided with the argon atmosphere to permit the Mg component thereof to infiltrate into the preform;

melting the first and second aluminum matrix alloy ingots while in the furnace to permit spontaneous infiltration of molten aluminum matrix alloy into the perform; and cooling the interior of the furnace.

12. A method for producing an aluminum alloy composite material as set forth in claim 11; wherein the sublimating step comprises raising the internal temperature of the furnace up to a predetermined temperature and maintaining the predetermined temperature for a given period of time so that the infiltration enhancer sublimates to permit an Mg component thereof to infiltrate into the preform.

13. A method for producing an aluminum alloy composite material as set forth in claim 11; wherein the melting step comprises raising the internal temperature of the furnace up to a predetermined temperature and maintaining the predetermined temperature for a given period of time so that the aluminum matrix alloy ingot melts to permit the aluminum matrix alloy to spontaneously infiltrate into the preform.

* * * * *